US012281544B2

(12) United States Patent
McChesney et al.

(10) Patent No.: US 12,281,544 B2
(45) Date of Patent: Apr. 22, 2025

(54) METHOD OF USING A MAGNETIC ARRAY TO STRENGTHEN/DIRECT MAGNETIC FLUX IN A DOWNHOLE FLOW CONTROL VALVE COUPLER AND POWER GENERATOR

(71) Applicant: Halliburton Energy Services, Inc., Houston, TX (US)

(72) Inventors: Ryan W. McChesney, Carrollton, TX (US); Stephen Michael Greci, Carrollton, TX (US); Gordon McLeary, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 5 days.

(21) Appl. No.: 18/206,233

(22) Filed: Jun. 6, 2023

(65) Prior Publication Data

US 2024/0410257 A1 Dec. 12, 2024

(51) Int. Cl.
*E21B 41/00* (2006.01)
*E21B 43/12* (2006.01)

(52) U.S. Cl.
CPC ..... *E21B 41/0085* (2013.01); *E21B 43/12* (2013.01)

(58) Field of Classification Search
CPC .. E21B 41/0085; E21B 43/12; E21B 43/1235; H02K 7/1823
See application file for complete search history.

(56) References Cited

U.S. PATENT DOCUMENTS

| | | | |
|---|---|---|---|
| 9,822,611 | B2 | 11/2017 | Delzell et al. |
| 10,246,976 | B2 | 4/2019 | DeCarlo |
| 11,236,587 | B2 | 2/2022 | Greci et al. |
| 11,371,343 | B2 | 6/2022 | Greci et al. |
| 11,401,780 | B2 | 8/2022 | Fripp et al. |
| 11,441,392 | B2 | 9/2022 | Fripp et al. |
| 11,506,031 | B2 | 11/2022 | Greci et al. |
| 11,530,596 | B2 | 12/2022 | McChesney et al. |
| 2008/0047753 | A1 | 2/2008 | Hall et al. |

(Continued)

FOREIGN PATENT DOCUMENTS

| | | | |
|---|---|---|---|
| CA | 3159472 | A1 | 6/2021 |
| WO | 2018125048 | A1 | 7/2018 |

(Continued)

OTHER PUBLICATIONS

Foreign Communication from Related Application—International Search Report and Written Opinion of the International Searching Authority, International Application No. PCT/US2023/024673, dated Feb. 27, 2024, 12 pages.

*Primary Examiner* — Tara Schimpf
*Assistant Examiner* — Lamia Quaim
(74) *Attorney, Agent, or Firm* — Conley Rose, P.C.; Rodney B. Carroll

(57) ABSTRACT

A magnetic coupling mechanism in a downhole flow control tool comprising a first chamber within a flow path of wellbore fluids with a first component comprising a Halbach array of magnets. A second chamber isolated from the wellbore environment comprises a second component with a Halbach array of magnets. The first chamber and the second chamber are coupled with a nonmagnetic separation. The second component is translated with the first component by a strong magnetic flux produced by the array of magnets.

18 Claims, 8 Drawing Sheets

(56) References Cited

U.S. PATENT DOCUMENTS

| | | | | |
|---|---|---|---|---|
| 2016/0053589 | A1 | 2/2016 | Delgado | |
| 2018/0320482 | A1* | 11/2018 | Agnihotri | E21B 17/028 |
| 2019/0010783 | A1* | 1/2019 | Frosell | E21B 41/0085 |
| 2021/0175778 | A1 | 6/2021 | Gerard et al. | |
| 2021/0355799 | A1 | 11/2021 | Greci | |
| 2021/0363998 | A1 | 11/2021 | Brown et al. | |
| 2022/0356781 | A1 | 11/2022 | Fripp et al. | |

FOREIGN PATENT DOCUMENTS

| | | | |
|---|---|---|---|
| WO | 2021105366 | A1 | 6/2021 |
| WO | 2022139811 | A1 | 6/2022 |

* cited by examiner

METHOD OF USING A MAGNETIC ARRAY TO STRENGTHEN/DIRECT MAGNETIC FLUX IN A DOWNHOLE FLOW CONTROL VALVE COUPLER AND POWER GENERATOR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are commonly obtained from subterranean formations that may be located onshore or offshore. The construction of a hydrocarbon producing well can comprise a number of different steps. Typically, the construction begins with drilling a wellbore at a desired wellsite, treating the wellbore to optimize production of hydrocarbons, and installing completion equipment to produce the hydrocarbons from the subterranean formation. During production of the formation fluid, formation sand may be swept into the flow path. The formation sand tends to be relatively fine sand that can erode production components in the flow path.

When formation sand is expected to be encountered in formation fluid, a lower completion assembly may be installed in the production zone between the formation and the production tubing comprising a plurality of sand screen assemblies. Each sand screen assembly generally includes a filter media, such as a sand screen, to filter fines from the formation fluid. The inflow of formation fluids can be balanced across the plurality of sand screen assembly inflow control devices ("ICDs") that are configured to meter the inflow of formation fluids along the length of a lower completion assembly. Traditionally, ICDs are operated utilizing electric or hydraulic control lines extending from the surface, or through use of equipment lowered from the surface, or are otherwise autonomous in their operation, with no external control. An addressable ICD can utilize a power harvesting device to power a unit controller and one or more valves. The power harvesting device can utilize a turbine within a production flow passage to generate electric power. Fines within the production fluid may erode or foul the power harvesting device. A method of separating the power harvesting device from the erosive produced formation fluid is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
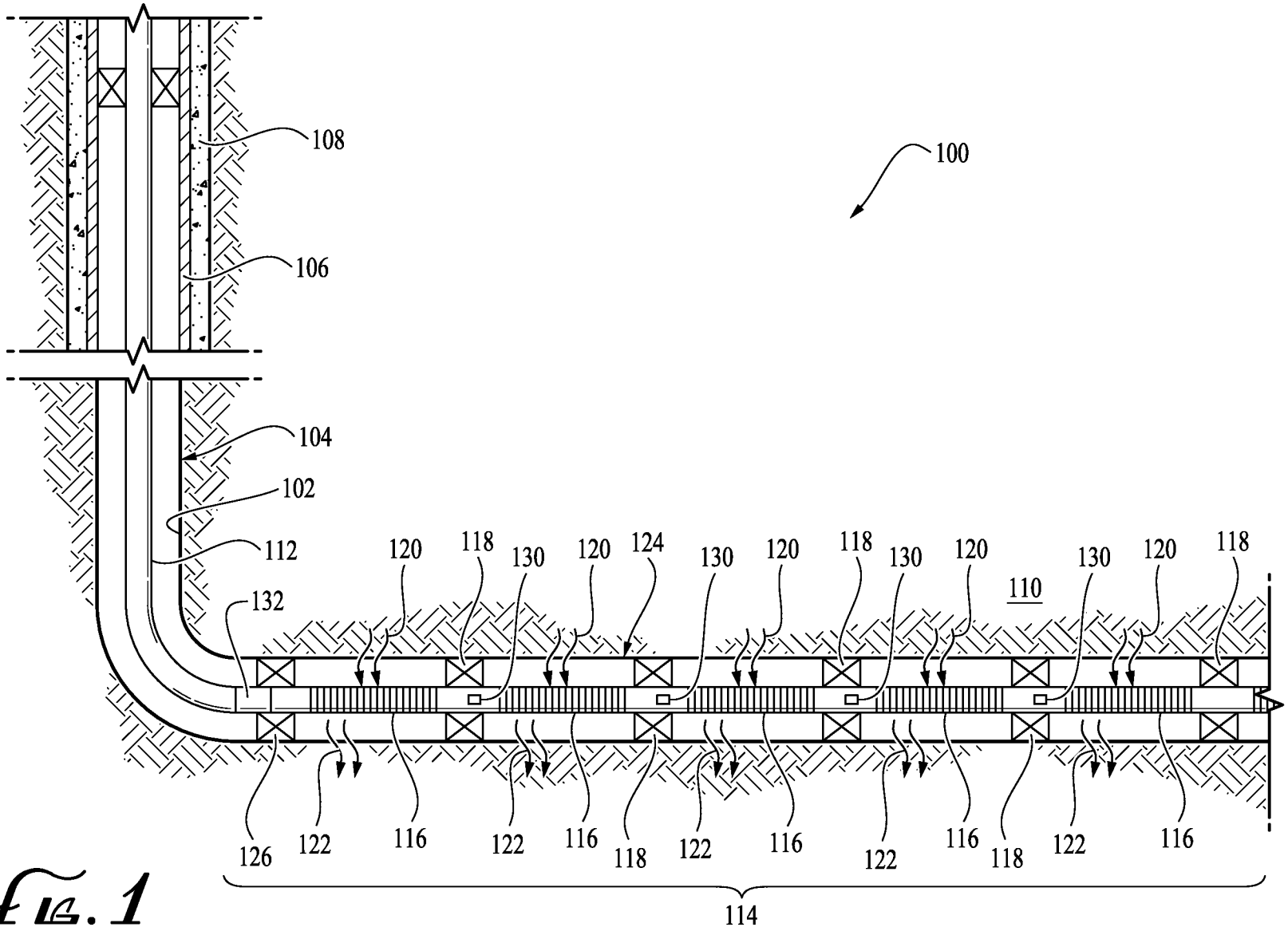
FIG. 1 is a diagram illustrating an exemplary environment for a turbine assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "uphole," "downhole," "up," and "down" are defined relative to the location of the earth's surface relative to the subterranean formation. "Down" and "downhole" are directed opposite of or away from the earth's surface, towards the subterranean formation. "Up" and "uphole" are directed in the direction of the earth's surface, away from the subterranean formation or a source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Hydrocarbons, such as oil and gas, are produced or obtained from subterranean reservoir formations that may be located onshore or offshore. The development of subterranean operations and the processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

During the completion operations, a completion string, for example, a packer and at least one sand screen, may be used to isolate a production zone when erosive sand particles are present or predicted within the fluids produced from the formation, e.g., production fluids. The completion operation can comprise an upper completion string and a lower completion string, also referred to as a lower completion assembly. Generally, a lower completion assembly comprises at least one sand screen comprising a base pipe with a flow passage and a filter media, e.g., sand screen, disposed around a portion of the base pipe. The filter media can be formed with a filtered flow area formed between the filter media and the base pipe. An adjustable electronic flow control node can be positioned along the base pipe and fluidically coupled to the filter media via the filter flow area. The adjustable electronic flow control node comprises a power harvesting device, a valve body, a flow control valve, and unit controller with a transceiver. The power harvesting device can be located within the flow passage between the filter media and valve body. A flow of production fluids through the flow passage can generate electrical power for the unit controller and flow control device. The unit controller can actuate the flow control device to position the flow control valve into a desired position within the valve body to meter the flow of production fluids from the flow passage and valve housing to an exit port. The transceiver can receive signals from the wellbore, e.g., electromagnetic signal or a pressure signal, comprising instructions for the position of the flow control valve.

In some embodiments, the electronic flow control nodes may be used to inject a working fluid into the wellbore annulus around the respective sand screen assembly. For example, a gravel pack slurry, acidizing treatment, hydraulic fracturing fluid or cake breaking fluid may be injected into the wellbore annulus.

In some embodiments, the lower completion can comprise two or more electronic flow control nodes configured to be operated in concert to achieve a particular objective. For example, the electronic flow control nodes may be sequentially opened and/or closed along the string.

In some embodiments, the power harvesting device can be divided into a clean side and a dirty side. The clean side of the power harvesting device can include a magnetic rotor coupled to a shaft of a generator. The dirty side of the power harvesting device can include a turbine with a magnetic hub, also referred to as a magnetic turbine. The magnetic flux between the magnetic rotor and the magnetic turbine can rotationally couple the magnetic rotor and the magnetic turbine. However, the torque capacity of the magnetic flux can limit the speed of the magnetic turbine.

A Halbach array can provide a solution to the limited toque capacity of the magnetic flux. A Halbach array is an orientation of magnetic poles of magnets into a pattern to increase the density of the magnetic flux. A plurality of magnets can be installed into the magnetic rotor and magnetic turbine arranged into a Halbach array with matching pole directions to increase the density of the magnetic flux and thus, increase the torque capacity of the magnetic flux.

Turning now to FIG. 1, an exemplary environment 100 for a turbine assembly is illustrated. In some embodiments, wellsite environment 100 comprises a wellbore 102 extending from a surface location to a permeable subterranean formation 110. The wellbore 102 can be drilled from surface location using any suitable drilling technique. The wellbore 102 can include a substantially vertical portion 104 that transitions to a deviated portion and into a substantially horizontal portion 124. In some embodiments, the wellbore 102 may comprise a nonconventional, horizontal, deviated, multilateral, or any other type of wellbore. Wellbore 102 may be defined in part by a casing string 106 that may extend from a surface location to a selected downhole location. The casing string 106 may be isolated from the wellbore by cement 108. Portions of wellbore 102 that do not comprise the casing string 106 may be referred to as open hole. Although the horizontal portion 124 is illustrated as an open hole section, it is understood that the horizontal section can include a casing string 106 and/or cement 108. While the wellsite environment 100 illustrates a land-based subterranean environment, the present disclosure contemplates any wellsite environment including a subsea environment. In one or more embodiments, any one or more components or elements may be used with subterranean operations equipment located on offshore platforms, drill ships, semi-submersibles, drilling barges, and land-based rigs.

A production string 112 may be positioned within the wellbore 102 and extend from the surface location. The production string 112 can be any piping, tubular, or fluid conduit including, but not limited to, drill pipe, production tubing, casing, coiled tubing, and any combination thereof. The production string 112 provides a conduit for production fluids extracted from the formation 110 to travel to the surface. The production string 112 may additionally provide a conduit for fluids to be conveyed downhole and injected into the formation 110, such as in an injection operation.

In some embodiments, the production string 112 can be releasably coupled to a lower completion 114. For example, the production string 112 can mechanically and sealingly couple to the lower completion 114 by a completion assembly 132, e.g., an anchor assembly. In some embodiments, the production string 112 can couple to the lower completion by a mechanical coupling 132. The lower completion 114 can divide the production zone into various production intervals adjacent the formation 110. The production zone can be the area within the wellbore 102 where various wellbore operations are to be undertaken using the lower completion 114, such as production or injection operations.

As illustrated in FIG. 1, the lower completion 114 includes an isolation packer 126 and a plurality of sand control screen assemblies 116 axially offset from each other along portions of the lower completion 114. The isolation packer 126 can anchor and seal the lower completion 114 within the production zone. A zonal packer 118 can be placed between each screen assembly 116 to form a seal between the outer surface of the lower completion 114 and the inner surface of the wellbore 102 thereby defining corresponding production intervals. In operation, the screen assemblies 116 can filter particulate matter out of production fluid such that particulates and other fines are not produced to the surface and to prevent particulates from clogging portions of the lower completion 114. Although the screen assemblies 116 are illustrated as being located in an open hole portion of the wellbore 102, it is understood that one or more of the screen assemblies 116 can be arranged within cased portions of the wellbore 102. Although a single screen assembly 116 is illustrated being located in each production interval, it is understood that 0, 1, 2, 3, 4, 5, 6, 7, 8, 9, 10, or any number of screen assemblies 116 may be located within a particular production interval. Although the lower completion 114 is illustrated with multiple production intervals separated by the zonal packers 118, it is understood that the production zone may include 0, 1, 2, 3, 4, 5, 6, 7, 8, 9, 10, or any number of production intervals with a corresponding number of zonal packers 118 used therein. Although the lower completion 114 is illustrated in a horizontal portion 124 of the wellbore 102, it is understood that the lower completion 114 can be located in a vertical portion 104, a deviated section, a multilateral section, or combinations thereof.

In some embodiments, the lower completion 114 can be used to undertake various wellbore operations. For example, the lower completion 114 can be used to extract production fluids 120 from the formation 110 and transport those fluids 120 to the surface via the production string 112. The production fluids 120 can be water, oil, gas, acids, or any combination thereof.

In some embodiments, the lower completion 114 may be used to inject fluids 122 with various service operations into the surrounding subterranean formation 110. For example, the lower completion 114 can be used with hydraulic fracturing operations, steam-assisted gravity drainage (SAGD) operations, wellbore treatment operations, gravel packing operations, acidizing operations, or any combination thereof. Accordingly, the injected fluids 122 may be water, fracturing fluids, steam, gas, aqueous or liquid chemicals, slurry, acids, or any combination thereof.

In some embodiments, the lower completion 114 comprises an adjustable electronic flow control node 130, also referred to as an eICD 130, located within each production interval. The eICD 130 can operate as a flow regulation devices, such as variable chokes and valves, to regulate the flow of the fluids 120, 122 into and/or out of the lower completion 114. The eICD 130 can receive signals from the surface via a transceiver and actuate the flow regulation devices accordingly as will be described further herein.

Figure 2:
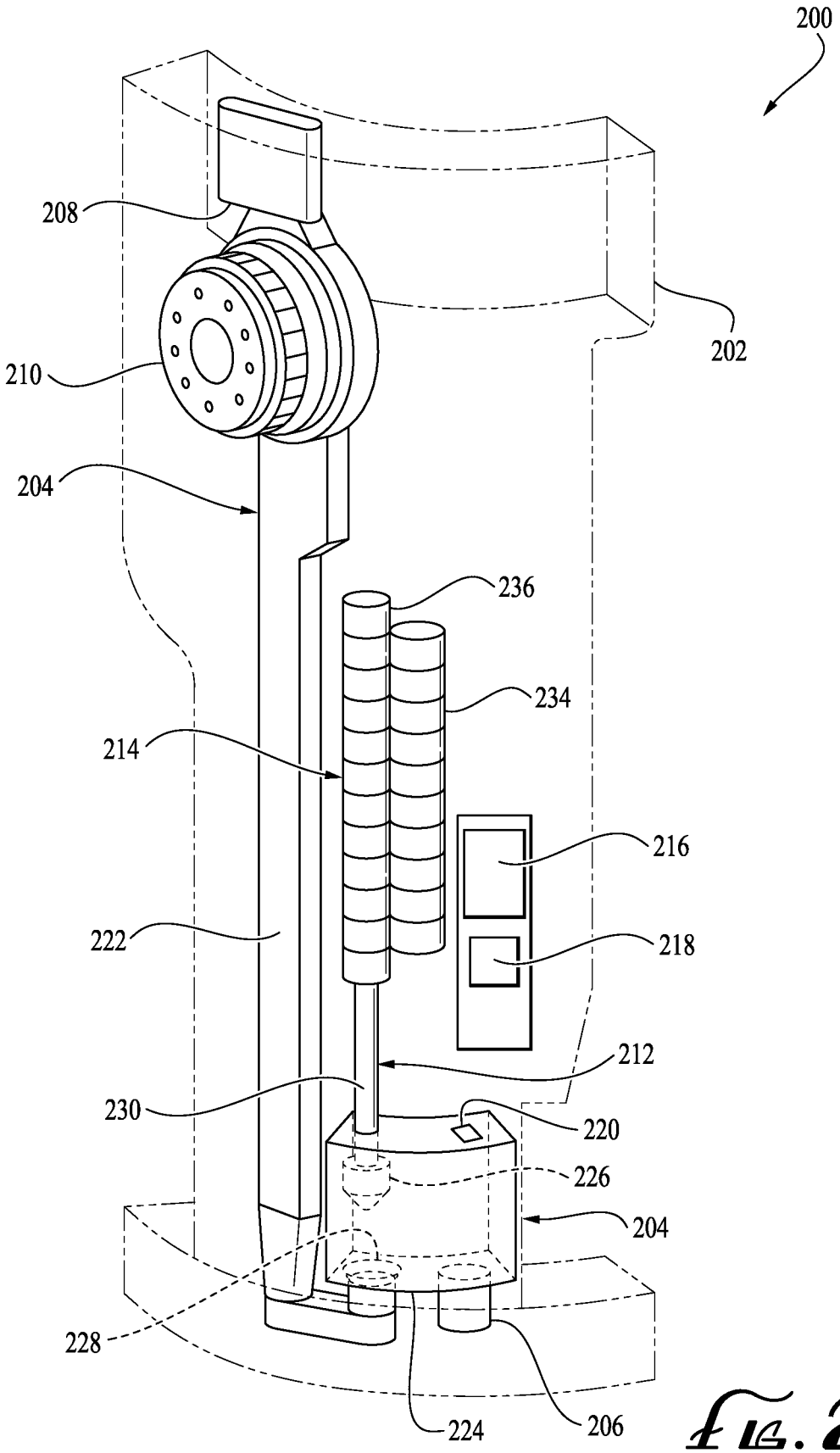
FIG. 2 is a perspective view of an adjustable electronic flow control nodes according to an embodiment of the disclosure.

Turning now to FIG. 2, a perspective view of an adjustable electronic flow control nodes can be described. In some embodiments, an eICD 200, e.g., an adjustable electronic flow control node, can be an embodiment of the eICD 130 shown in FIG. 1. The eICD 200 comprises a valve body 202 having a flow path 204 defined therethrough extending between a first fluid port 206 and a second fluid port 208. A power harvesting device 210 may be disposed along the flow path 204. Flow path 204 may be defined by one or more fluid channels or fluid ducts 222 formed in the valve body 202, and may likewise include one or more flow chambers 224 fluidically coupling the channels 222 with the first fluid port 206 and the second fluid port 208. In some embodiments, power harvesting device 210 is a turbine generator or blade generator that can be actuated by fluid flow along the flow path 204. In other embodiments, power harvesting device 210 may be disposed to be actuated by fluid flow external of the valve body 202, for example, production flow flowing past eICD 200.

In some embodiments, production fluid can flow from the second fluid port 208 to the first fluid port 206. In some embodiments, injection fluid can flow from the first fluid port 206 to the second fluid port 208. The fluid flow from the first fluid port 206 to the second fluid port 208, or vice-versa, can be metered by an adjustable valve 212. The adjustable valve 212 can be a needle valve, a globe valve, a poppet valve, a gate valve, a ball valve or any suitable valve type. As illustrated in FIG. 2, the adjustable valve 212 can be a needle valve comprising a stem 230, a stem head 226, and a valve seat 228. A drive mechanism 214 can linearly position the stem head 226 relative to the valve seat 228. The drive mechanism 214 can move the stem head 226 into a first position with full contact with the valve seat 228 to shut off the fluid flow within the flow chamber 224, e.g., between the valve seat 228 and the first fluid port 206. The drive mechanism 214 can move or position the stem head 226 away from, or distal to, the valve seat 228 to a second position to allow a maximum potential flow rate through the flow chamber 224 and through the flow path 204. The drive mechanism 214 can position the stem head 226 in a third position, also referred to as a metering position, located between the first position and second position to reduce the flowrate of fluids within the flow path 204 to a desired flowrate.

In some embodiments, the adjustable valve 212 may establish a desired flowrate along the flow path 204 for different operations. For example, the adjustable valve 212 may positioned in the second position, e.g., fully open position, for fluid injection operations, such as acidizing, hydraulic fracturing, gravel packing and the like. In some embodiments, the adjustable valve 212 can establish a desired flow rate for production, e.g., fluid flow from the second fluid port 208 to the first fluid port 206. In some scenarios, the adjustable valve 212 can be placed in the third position to meter the flowrate of production fluids through the flow path 204.

In some embodiments, the drive mechanism 214 comprises a drive side magnet 234, a wet side valve spool 236, and an actuator. The actuator (not shown) can be an electric actuator coupled to the drive side magnet 234. A unit controller 216 can be communicatively coupled to the actuator to provide power and instruction to establish a position of the drive side magnet 234. The drive side magnet 234 can be magnetically coupled to the wet side valve spool 236 by a plurality of magnets. One or more sensors 220 can provide feedback to the unit controller 216 of the position of the actuator, the drive side magnet 234, the stem head 226, or combinations thereof. For example, the sensor 220 can be a positional sensor coupled to the actuator, the drive side magnet 234, the stem head 226, or combinations thereof. In another scenario, the sensor 220 can be a pressure sensor, a temperature sensor, a flow sensor to measure the environment within the flow chamber 224. The unit controller 216 can receive a wireless signal from a transceiver 218, for example, a pressure signal. The unit controller 216 can receive a signal and move the stem head 226 to a first position, a second position, or a third position in response to the signal with the sensor 220 providing feedback of the position. Although the sensor 220 is illustrated as a single sensor located within the flow chamber 224, it is understood that the sensor 220 can be multiple sensors located anywhere within the valve body 202 and/or external to the valve body 202. Although the transceiver 218 is described as receiving wireless signals, it is understood that the transceiver 218 can transmit wireless signals.

Figure 3A:
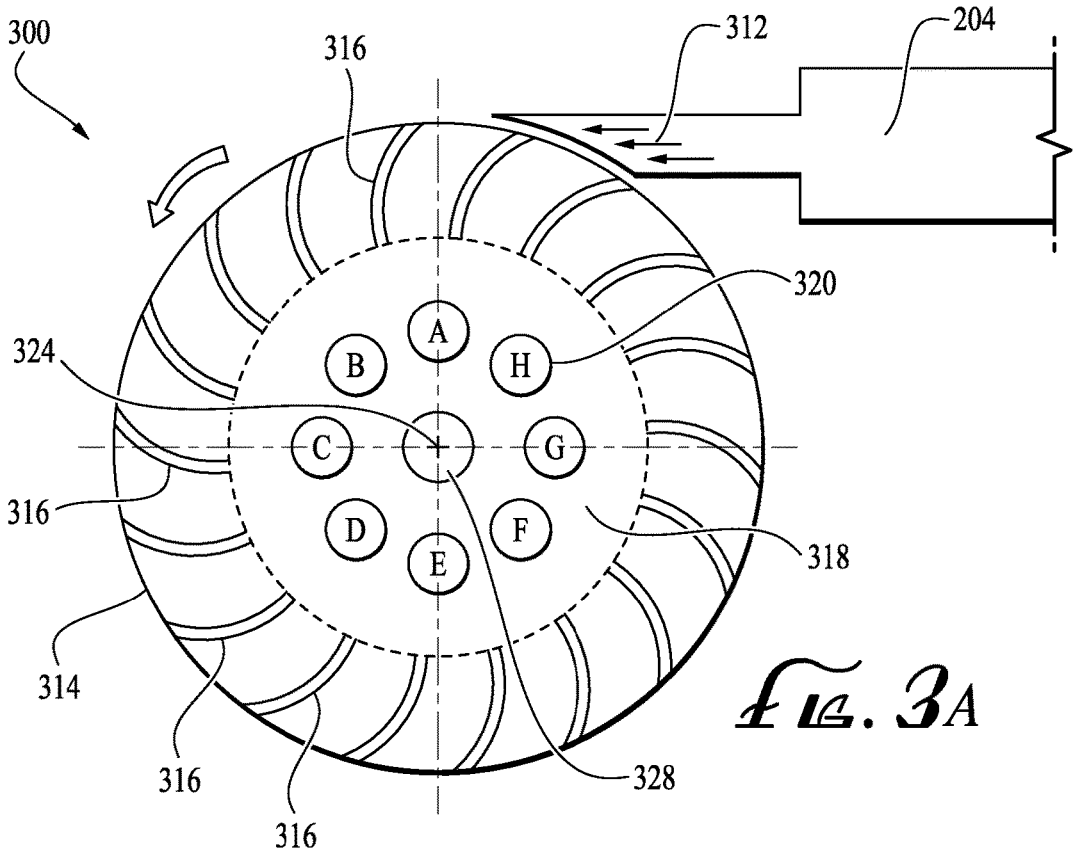
FIG. 3A is a top view illustrating an exemplary turbine according to an embodiment of the disclosure.

Turning now to FIG. 3A, a top view of an exemplary turbine can be described. In some embodiments, a turbine assembly 300 of the power harvesting device 210 may be configured to receive a flow of a fluid 312 from a flow path 204 (shown in FIG. 2) and convert the kinetic energy and potential energy of the fluid 312 into rotational motion and torque. The flow of the fluid 312 can be any type of fluid within the flow path 204, for example, injection fluids and/or production fluids. The turbine assembly 300 can include a turbine body 314 with a plurality of turbine blades 316, a turbine hub 318, and at least one hub magnet 320. The turbine blades 316 can be distributed about the turbine hub 318 and configured to receive the fluid 312. The turbine blades 316 can be blades, plates, fins, or any other suitable element configured to transform fluid motion into rotational motion. For example, the turbine hub 318 can be urged to rotate in response to the fluid 312 impinging on the turbine blades 316. The turbine assembly 300 can be located in a first chamber or a turbine chamber 326. An axle 328 can be coupled to the turbine hub 318 at a center axis point and located in a receiving port within the turbine chamber 326. A plurality of hub magnets 320 can be mounted to or fixed within the turbine hub 318. Although the turbine hub 318 is illustrated with six hub magnets 320A-H, it is understood that the turbine hub 318 can comprise 1, 2, 3, 4, 5, 6, 7, 8, 9, 10, 11, 12, 13, 14, 15, 16, or any number of hub magnets 320. As illustrated in FIG. 3, the fluid 312 in the turbine assembly 300 is perpendicular to the central axis 324 of the turbine body 314. Although the turbine assembly 300 is illustrated as a cross-flow turbine, it is understood that the turbine assembly 300 can be any other type of turbine that is configured to generate rotational motion from fluid flow, for example, the fluid flow could be substantially parallel to the rotational axis or central axis 324 of the rotor.

Figure 3B:
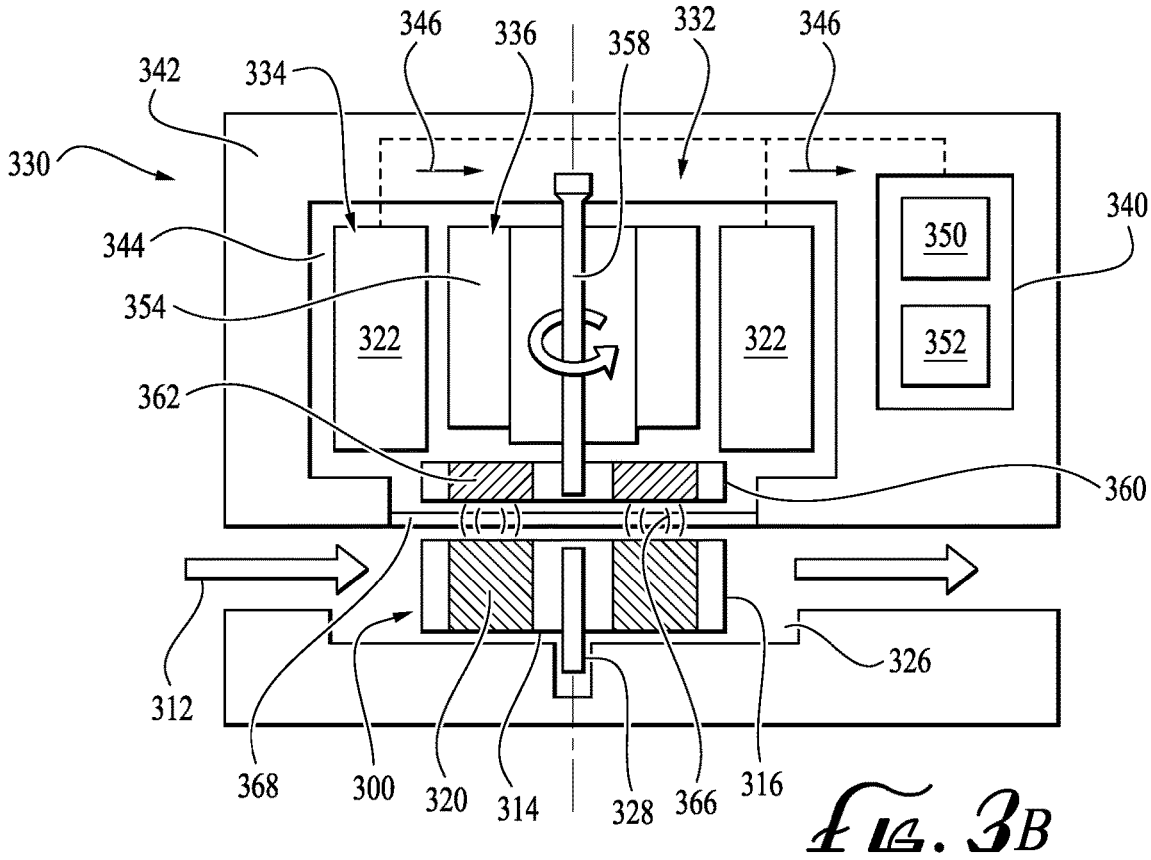
FIG. 3B is a schematic diagram illustrating an exemplary power harvesting device according to an embodiment of the disclosure.

Turning now to FIG. 3B, a schematic diagram illustrating an exemplary power harvesting device 330 can be described. In some embodiments, the power harvesting device 330 comprises the turbine assembly 300 and a generator 332. The generator 332 comprises a stator 334, a rotor 336, a rotor coupling 338, and a power unit 340 within a housing 342. The generator 332 can operate in a sealed chamber 344, also referred to as the second chamber, within the housing 342. The generator 332 can produce electrical power 346 when the rotor 336 is rotating within the stator 334. A power unit 340 comprises a rectifier circuit 350 and a power storage device 352 to condition and/or store the electrical power 346. The stator 334 can comprise a plurality of windings 322 mounted on a core. The rotor 336 can comprise a plurality of magnets 354 mounted about a rotor axle 358. A rotor coupling plate 360 can be a generally disk shape with a plurality of plate magnets 362 mount to or fixed with the rotor coupling plate 360. The rotor coupling plate 360 can be rotationally coupled to the rotor 336 by the rotor axle 358. The rotor coupling plate 360 can be magnetically coupled to the turbine assembly 300. The turbine assembly 300 can be located in the turbine chamber 326 also referred to as the first chamber. For example, a plurality of magnetic flux 366 can extend across a non-magnetic cap 368 from the plurality of plate magnets 362 to the plurality of hub magnets 320.

During operation, a flowrate of fluid within the flow path 204 can induce rotational motion of the turbine assembly 300. The plurality of magnetic flux 366 can rotationally couple the turbine assembly 300 to the rotor coupling plate 360, thus the rotational motion of the turbine assembly 300 can rotate the rotor 336 within the stator 334 to generate electrical power 346. The power unit 340 may store and deliver a steady power supply for consumption by a load, for example, the unit controller 216.

In an embodiment, the turbine assembly 300 and drive mechanism 214 may utilize a magnetic field generated by a Halbach Array to generate a plurality of magnetic fluxes 366 with the rotor coupling plate 360. In general, a Halbach Array comprises an arrangement of permanent magnets that augments the magnetic field on one side of the array while cancelling the field to near zero on the other side. The arrangement can comprise a spatially rotating pattern of magnetization. Halbach Arrays may be implemented in a variety of shapes such as array (bar or rod magnets), sheets, plates, and cylinders (e.g., in the form of Halbach Cylinders). When the Halbach Array is used with a cylindrical arrangement, the magnetic field may be augmented either inside or outside the cylinder, with a corresponding decrease in the magnetic field on the opposite side-either outside or inside the cylinder, respectively.

Generally, the magnets may be made from a material that is magnetized and creates its own persistent magnetic field. In an embodiment, the magnets of the turbine assembly 300 and drive mechanism 214 may be permanent magnets formed, at least in part, from one or more ferromagnetic materials. Suitable ferromagnetic materials useful with the magnets described herein may include, but are not limited to, iron, cobalt, rare-earth metal alloys, ceramic magnets, alnico nickel-iron alloys, rare-earth magnets (e.g., a Neodymium magnet and/or a Samarium-cobalt magnet). Various materials useful with the magnets of the turbine assembly 300 and drive mechanism 214 may include those known as Co-netic AAR, Mumetal®, Hipernon®, Hy-Mu-80®, Permalloy®, each of which comprises about 80% nickel, 15% iron, with the balance being copper, molybdenum, and/or chromium.

Figure 4:
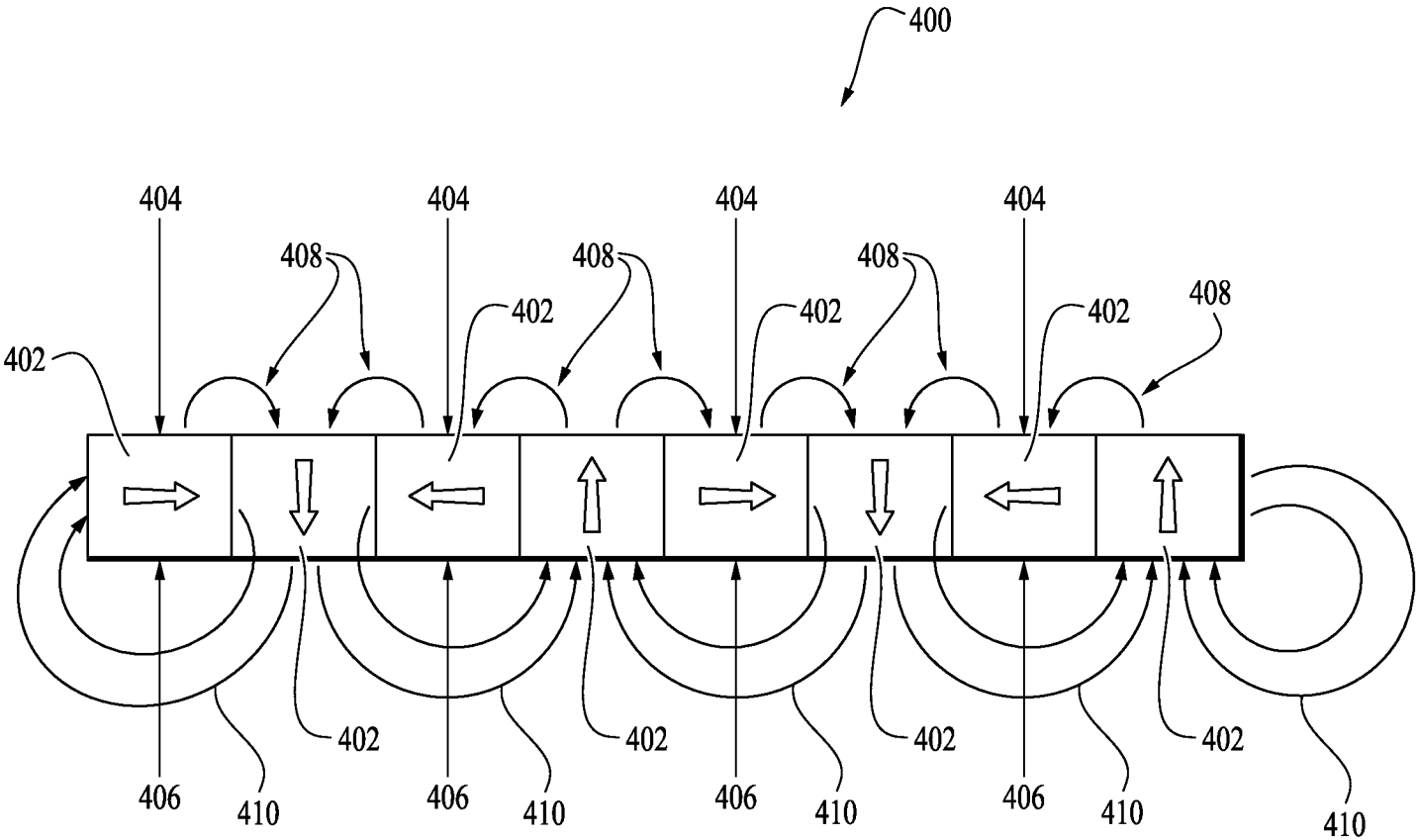
FIG. 4 is a schematic diagram illustrating an exemplary turbine assembly according to an embodiment of the disclosure.

Turning now to FIG. 4, an exemplary Halbach Array 400 comprising a plurality of magnets 402 may be arranged in a rotating pattern (in this case right, down, left, up, where "up" indicates north). The exemplary Halbach array 400 may be utilized in the drive mechanism 214 as that 236 and/or that 234. The rotating pattern of the permanent magnets 402 augments the magnetic field 410 on a first side 406 relative to the decreased field 408 on the second side 404. The degree of augmentation and/or cancellation of the decreased field 408, 410 on each side of the permanent magnets 402 may vary depending on various considerations such as the relative strength of the magnets and/or the alignment and orientation of the magnets. In an embodiment, the augmented magnetic field 410 is greater than the decreased field 408. In some embodiments, the ratio of the magnetic field strength of the decreased field 408 at a given distance from the magnets to the magnetic field strength of the augmented field 410 at the distance from the magnets on an opposite side of the magnets 402 may be in the range of from about 1:1000 to about 1:1.5, from about 1:100 to about 1:2, or from about 1:90 to about 1:4. The augmented field 410 of the Halbach Array can increase the amount of torque transfers to the generator 332 and the amount of linear force transferred to the adjust valve 230.

Figure 5A:
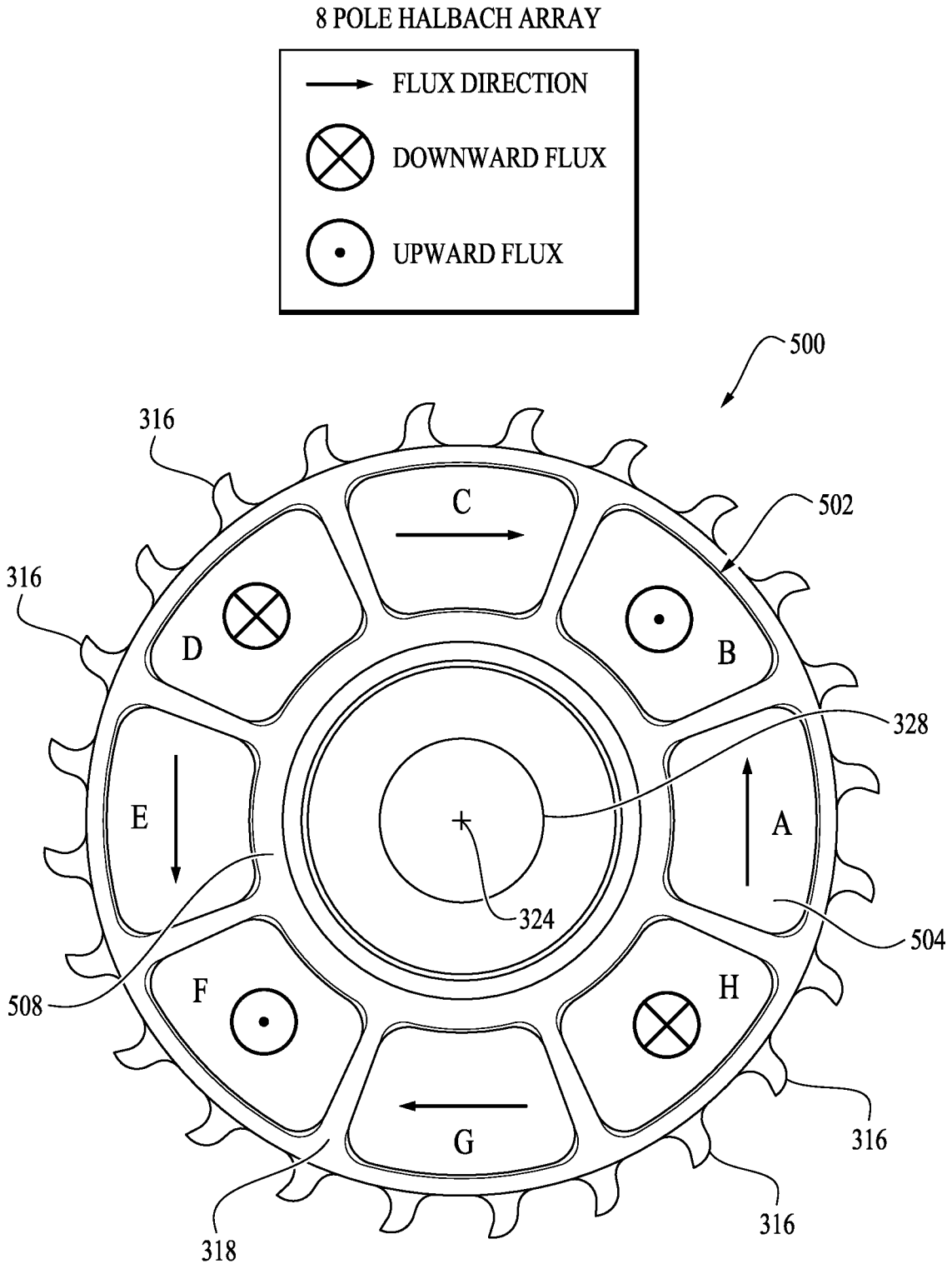
FIG. 5A is a top view illustrating an exemplary turbine with a magnetic coupling according to another embodiment of the disclosure.

Turning now to FIG. 5A, a top view illustrating an exemplary turbine body with a magnetic coupling can be described. In some embodiments, the exemplary turbine body 500 comprises a turbine hub 318, a plurality of blades 316, an axle 328, and Halbach array of wedge magnets 504. The wedge magnets 504 can be generally wedge or pie shaped magnets with a pole or flux oriented in the direction indicated. For example, magnet 504A can be oriented left, magnet 504B can be oriented up, magnet 504C can be oriented right, magnet 504D can be oriented down, magnet 504E can be oriented left, magnet 504F can be oriented up, magnet 504G can be oriented right, and magnet 504H can be oriented down. The rotating pattern of the permanent magnets 504 can augment the magnetic field on a first side 508. In some embodiments, a rotor coupling plate, e.g., plate 360, comprises a Halbach array of wedge magnets configured establish a plurality of augmented flux, e.g., flux 366, with the turbine body 500. The augment flux of the Halbach array between the turbine body 500 and the rotor coupling plate can increase the torque capacity of the generator 332 and increase the potential power output of the power harvesting device 330.

Figure 5B:
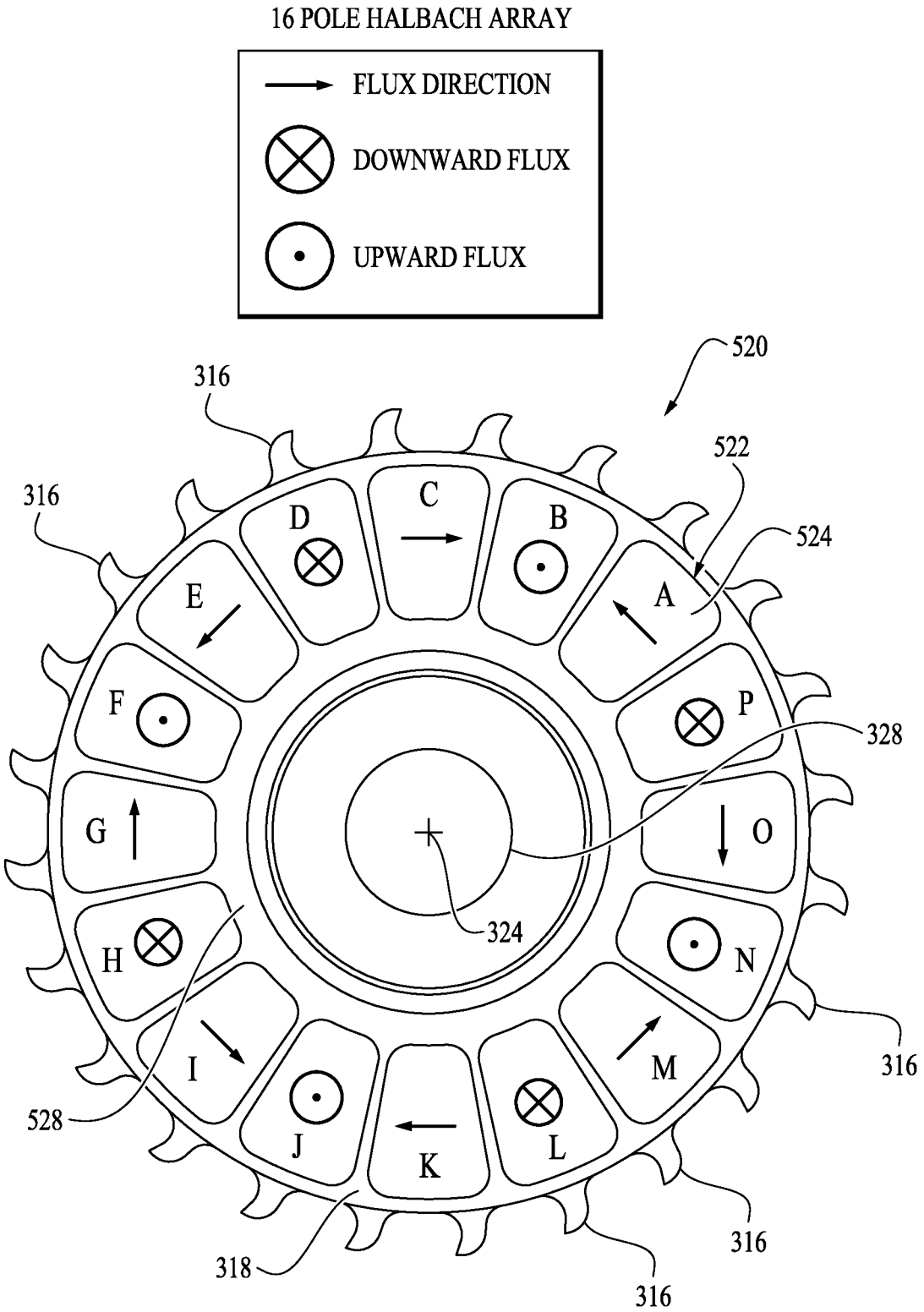
FIG. 5B is a top view illustrating an exemplary turbine with a magnetic coupling according to still another embodiment of the disclosure.

Turning now to FIG. 5B, a top view illustrating an exemplary turbine body with an enhance magnetic coupling can be described. In some embodiments, the exemplary turbine body 520 comprises a turbine hub 318, a plurality of blades 316, an axle 328, and Halbach array of narrow wedge magnets 524. The narrow wedge magnets 524 can be generally wedge or pie shaped magnets with a pole or flux oriented in the direction indicated. For example, magnet 524A can be oriented left, magnet 524B can be oriented up, magnet 524C can be oriented right, magnet 524D can be oriented down, magnet 524E can be oriented left, magnet

524F can be oriented up, magnet 524G can be oriented right, magnet 524H can be oriented down, magnet 524I can be oriented left, magnet 524J can be oriented up, magnet 524K can be oriented right, magnet 524L can be oriented down, magnet 524M can be oriented left, magnet 524N can be oriented up, magnet 524O can be oriented right, and magnet 524P can be oriented down. The rotating pattern of the permanent magnets 524 can augment the magnetic field on a first side 528. In some embodiments, a rotor coupling plate, e.g., plate 360, comprises a Halbach array of wedge magnets configured establish a plurality of augmented flux, e.g., flux 366, with the turbine body 520. The augment flux of the Halbach array between the turbine body 520 and the rotor coupling plate can increase the torque capacity of the generator 332 and increase the potential power output of the power harvesting device 330.

Figure 6:
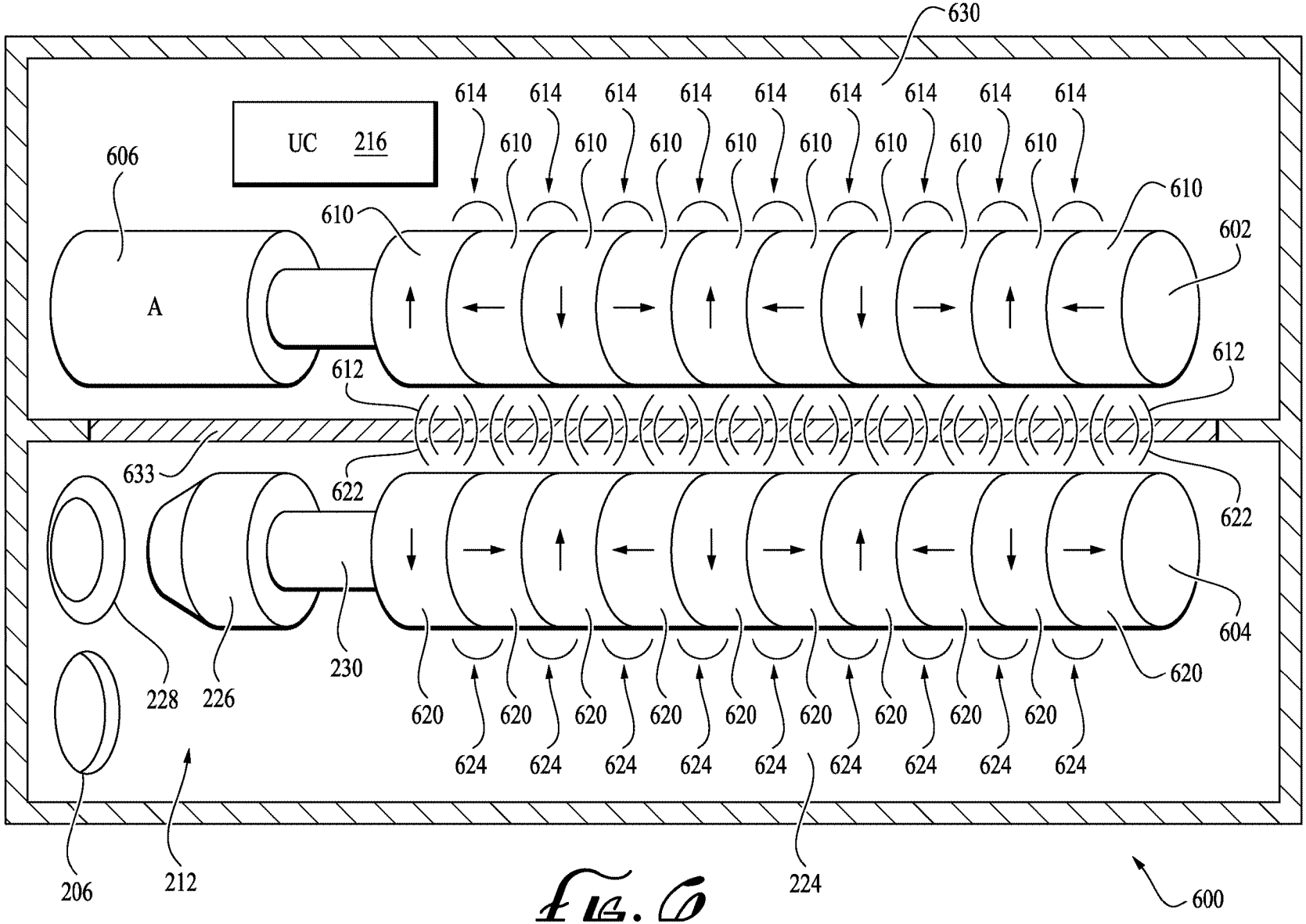
FIG. 6 is a perspective view of a valve with a magnetic coupling according to an embodiment of the disclosure.

Turning now to FIG. 6, a perspective view of a drive mechanism with a Halbach array can be described. In some embodiments, a drive mechanism 600 comprises a drive side magnet 602, a wet side valve spool 604, and an actuator 606. The actuator 606 can be an electric actuator coupled to the drive side magnet 602. A unit controller 216 can be communicatively coupled to the actuator 606 to provide power and instruction to establish a position of the drive side magnet 602. The drive side magnet 602 comprises a Halbach array of a plurality of magnets 610 arranged in a rotating pattern. The exemplary Halbach array can comprise magnets 610 with the orientation of up, left, down, right, up, left, down, right, up, and left. The rotating array of magnets 610 can establish an augmented, or strong side flux 612 oriented towards the wet side spool 604 and a decreased side, or weak side flux 614, oriented away from the wet side spool 604. The wet side spool 604 comprises a Halbach array of a plurality of magnets 620 arranged in a pattern of down, right, up, left, down, right, up, left, down, and right. The rotating array of magnets 620 can establish an augmented, or strong side flux 622 oriented towards the drive side magnet 602 and a decreased side, or weak side flux 624, oriented away from the drive side magnet 602. The drive side magnet 234 can be magnetically coupled to the wet side valve spool 236 through a non-magnetic wall 633 by with an augmented or strong side flux 612, 622.

The drive side magnet 602, the actuator 606, and the unit controller 216 can be located in a positioning chamber 630 within the valve body 202. The positioning chamber 630, also referred to as the second chamber, can be sealed and isolated from the wellbore environment. The wet side spool 604 and the valve 212 can be located within the flow chamber 224, also referred to as the first chamber, of the valve body 202. In a scenario, production fluid can exit the valve seat 228 into the flow chamber 224 and exit the first fluid port 206. The valve 212 can be positioned by the wet side spool 604 located within the flow chamber 224 to a first position, a second position, or a third position, e.g., a fully closed position, a fully open position, or a metered position.

Figure 7:
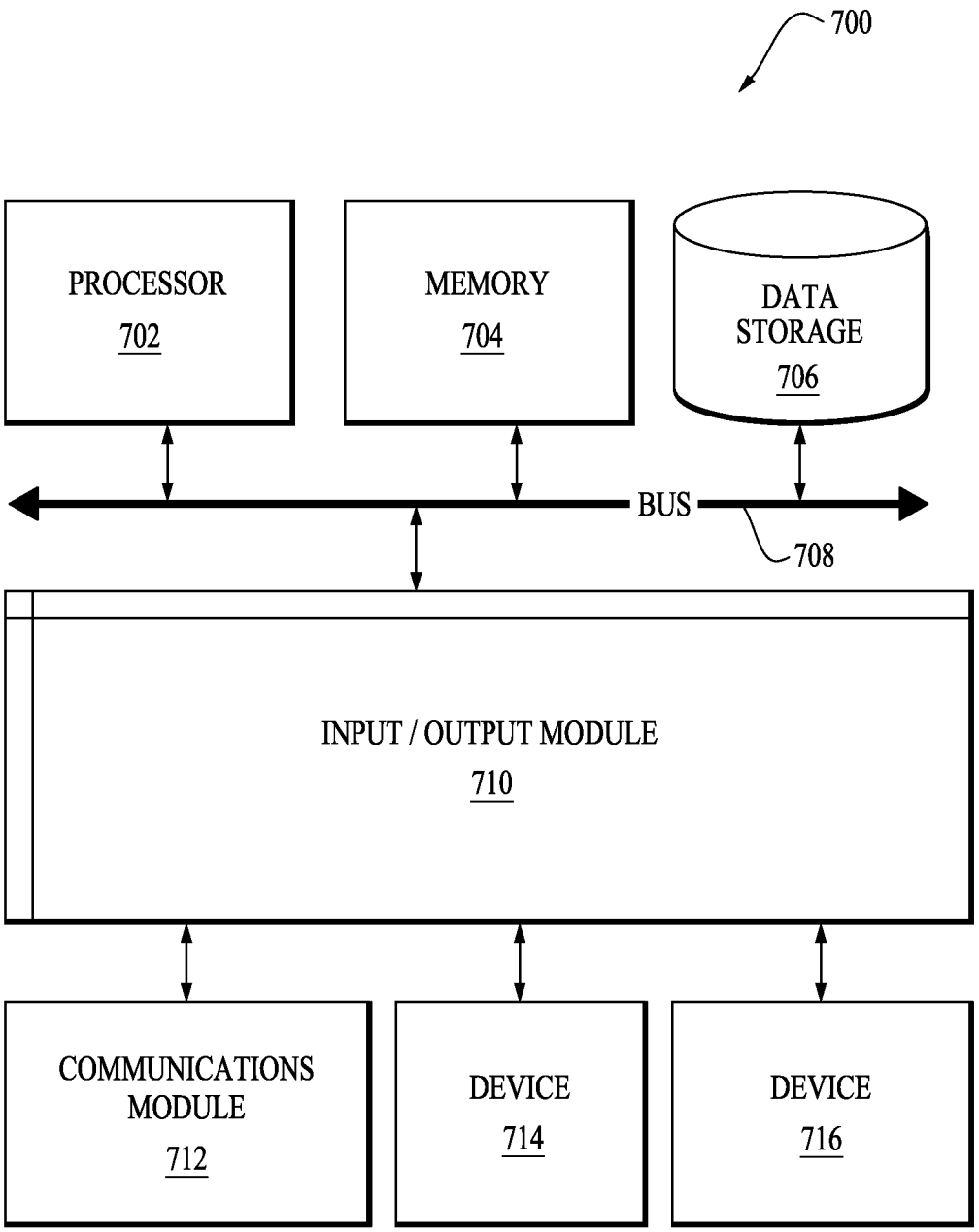
FIG. 7 is a block diagram illustrating an exemplary computer system according to an embodiment of the disclosure.

Turning now to FIG. 7, a computer system 700 suitable for implementing one or more embodiments of the unit controller, for example, unit controller 216, including without limitation any aspect of the computing system associated with the valve operation of FIG. 2 and FIG. 6. The computer system 700 includes one or more processors 702 (which may be referred to as a central processor unit or CPU) that is in communication with memory 704, secondary storage 706, input output devices 710, and network devices. The computer system 700 may continuously monitor the state of the input devices and change the state of the output devices based on a plurality of programmed instructions. The programming instructions may comprise one or more applications retrieved from memory 704 for executing by the processor 702 in non-transitory memory within memory 704. The input output devices may comprise a Human Machine Interface with a display screen and the ability to receive conventional inputs from the service personnel such as push button, touch screen, keyboard, mouse, or any other such device or element that a service personnel may utilize to input a command to the computer system 700. The secondary storage 706 may comprise a solid state memory, a hard drive, or any other type of memory suitable for data storage. The secondary storage 706 may comprise removable memory storage devices such as solid state memory or removable memory media such as magnetic media and optical media, i.e., CD disks. The computer system 700 can communicate with various networks with the network devices 714 comprising wired networks, e.g., Ethernet or fiber optic communication, and short range wireless networks such as Wi-Fi (i.e., IEEE 802.11), Bluetooth, or other low power wireless signals such as ZigBee, Z-Wave, 6LoWPan, Thread, and WiFi-ah. The computer system 700 may include a transceiver 218 for communicating wirelessly.

In some embodiments, the computer system 700 may comprise a DAQ card 716 for communication with one or more sensors. The DAQ card 716 may be a standalone system with a microprocessor, memory, and one or more applications executing in memory. The DAQ card 716 may be a card or a device within the computer system 700. In some embodiments, the DAQ card 716 may be combined with the input output device 710. The DAQ card 716 may receive one or more analog inputs, one or more frequency inputs, and one or more Modbus inputs. For example, the analog input may include a positional sensor, e.g., a linear sensor. For example, the frequency input may include a flow meter, i.e., a fluid system flowrate sensor. For example, the Modbus input may include a pressure transducer. The DAQ card 716 may convert the signals received via the analog input, the frequency input, and the Modbus input into the corresponding sensor data. For example, the DAQ card 716 may convert a frequency input from the flowrate sensor into flowrate data measured in gallons per minute (GPM).

Additional Disclosure

The following are non-limiting, specific embodiments in accordance and with the present disclosure:

A first embodiment, which is a magnetic coupling mechanism in a downhole flow control tool, comprising a first chamber configured to receive i) production fluids or ii) injection fluids; a first component with a plurality of magnets located within the first chamber, and wherein the plurality of magnets are configured in a Halbach Array; a second chamber configured to exclude a wellbore environment; a second component with a plurality of magnets located within the second chamber, and wherein the plurality of magnets are configured in a Halbach Array; wherein the first chamber and the second chamber share a non-magnetic separation; and wherein the first component is magnetically coupled to the second component by a plurality of strong magnetic flux.

A second embodiment, which is the magnetic coupling mechanism of the first embodiment, wherein the plurality of magnets in the first component are configured to produce a weak magnetic flux directed away from the non-magnetic separation and a strong magnetic flux directed towards the non-magnetic separation.

A third embodiment, which is the magnetic coupling mechanism of any of the first and the second embodiments, wherein the plurality of magnets in the second component are configured to produce a weak magnetic flux directed away from the non-magnetic separation and a strong magnetic flux directed towards the non-magnetic separation.

A fourth embodiment, which is the magnetic coupling mechanism of any of the first through the third embodiments, wherein the first component is configured to axially translate; and wherein the second component is biased to axially translate by the plurality of strong magnetic flux.

A fifth embodiment, which is the magnetic coupling mechanism of the first through the fourth embodiments, wherein the first component is configured to rotationally translate; and wherein the second component is biased to rotationally translate by the plurality of strong magnetic flux.

A sixth embodiment, which is the magnetic coupling mechanism of any of the first through the fifth embodiments, wherein the first component and the second component are separated by the non-magnetic separation.

A seventh embodiment, which is the magnetic coupling mechanism of any of the first through the sixth embodiment, wherein the downhole flow control tool comprises a valve body with a flow path, an energy harvesting device, an adjustable valve, and a unit controller.

An eighth embodiment, which is the magnetic coupling mechanism of any of the first through the seventh embodiments, wherein the flow path comprises a first fluid port within a fluid chamber fluidically coupled to a second fluid port via at least one fluid duct; wherein the energy harvesting device comprises a generator and a turbine assembly; wherein the turbine assembly is fluidically coupled to the flow path and located between the second fluid port and the fluid chamber; and wherein the turbine assembly is configured to induce rotation within the generator.

A ninth embodiment, which is the magnetic coupling mechanism of any of the first through the eighth embodiments, wherein the first component and the second component are located within the energy harvesting device.

A tenth embodiment, which is the magnetic coupling mechanism of any of the first through the ninth embodiments, wherein the adjustable valve comprises a drive mechanism and a stem head; wherein the drive mechanism is communicatively coupled to the unit controller; wherein the stem head is located within a fluid chamber; and wherein the drive mechanism is configured to position the stem head in i) a first position, ii) a second position, or iii) a third position.

An eleventh embodiment, which is magnetic coupling seal mechanism of any of the first through the tenth embodiments, wherein the first component and the second component are located within the adjustable valve.

A twelfth embodiment, which a method of actuating a downhole mechanism by a magnetic coupling within a downhole tool assembly, comprising positioning a first component in a first chamber, wherein the first component comprises a plurality of magnets, wherein the plurality of magnets are configured to produce a strong magnetic flux on a first side; positioning a second component into a second chamber, wherein the second component comprises a plurality of magnets, wherein the plurality of magnets are configured to produce a strong magnetic flux on a second side; wherein the first chamber and the second chamber are coupled by a non-magnetic separation; wherein the first side of the first component is oriented towards the non-magnetic separation; wherein the second side of the second component is oriented towards the non-magnetic separation; magnetically coupling the strong magnetic flux on the first side of the first component to the strong magnetic flux on the second side of the second component; and actuating the second component with the first component.

A thirteenth embodiment, which is the method of the twelfth embodiment, wherein the first chamber comprises a flow path for wellbore fluids; and wherein the second chamber excludes a wellbore environment.

A fourteenth embodiment, which is the method of the thirteenth embodiment, further comprising rotating the first component with a flowrate of wellbore fluids; and generating electrical power within the second chamber in response to a rotational motion of the second component.

A fifteenth embodiment, which is the method of any of the thirteenth through the fourteenth embodiment, wherein the first chamber excludes the wellbore environment; and wherein the second chamber comprises a flow path for wellbore fluids.

A sixteenth embodiment, which is the method of any of the thirteenth through the fifteenth embodiment, further comprising positioning a first component with an actuator into i) a first position, ii) a second position, or iii) a third position; and changing a flowrate of wellbore fluids within the flow path with a second component in response to the position of the first component.

A seventeenth embodiment, which is the method of any of the thirteenth through the fifteenth embodiment, wherein the wellbore fluids are i) production fluids or ii) injection fluids.

An eighteenth embodiment, which is a downhole flow control tool system, comprising a first component in a first chamber, wherein the first component comprises a plurality of magnets, wherein the plurality of magnets are configured to produce a strong magnetic flux on a first side; a second component in a second chamber, wherein the second component comprises a plurality of magnets, wherein the plurality of magnets are configured to produce a strong magnetic flux on a second side, and wherein the first chamber and the second chamber are coupled by a non-magnetic separation; a magnetic coupling by the strong magnetic flux on the first side of the first component and the strong magnetic flux on the second side of the second component; and wherein the magnetic coupling is configured to: actuating the second component with the first component.

A nineteenth embodiment, which is the downhole flow control tool system of the eighteenth embodiment, wherein actuating the second component with the first component further comprises: rotating the first component within a flow path with a flowrate of wellbore fluids; and generating electrical power within the second chamber that excludes a wellbore environment in response to a rotational motion of the second component.

A twentieth embodiment, which is the downhole flow control tool system of the eighteenth or nineteenth embodiment, wherein actuating the second component with the first component further comprises: positioning a first component with an actuator into i) a first position, ii) a second position, or iii) a third position, wherein the first chamber excludes a wellbore environment; and changing a flowrate of wellbore fluids within a flow path with a second component in response to the position of the first component.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . , 50 percent, 51 percent, . . . , 52 percent, 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A magnetic coupling mechanism in a downhole flow control tool, comprising:

a first chamber configured to receive i) production fluids or ii) injection fluids;

a first component with a plurality of magnets located within the first chamber, and wherein the plurality of magnets are configured in a Halbach Array;

a second chamber;

a second component with a plurality of magnets located within the second chamber, and wherein the plurality of magnets are configured in a Halbach Array;

wherein the first chamber and the second chamber share a non-magnetic separation;

wherein the first component is magnetically coupled to the second component by a plurality of strong magnetic flux, wherein the downhole flow control tool comprises a valve body with a flow path, an energy harvesting device, an adjustable valve, and a unit controller, wherein the flow path comprises a first fluid port within a fluid chamber fluidically coupled to a second fluid port via at least one fluid duct, wherein the energy harvesting device comprises a generator and a turbine assembly, wherein the turbine assembly is fluidically coupled to the flow path and located between the second fluid port and the fluid chamber, and wherein the turbine assembly is configured to induce rotation within the generator.

2. The magnetic coupling mechanism of claim 1, wherein:

the plurality of magnets in the first component are configured to produce a weak magnetic flux directed away from the non-magnetic separation and a strong magnetic flux directed towards the non-magnetic separation.

3. The magnetic coupling mechanism of claim 1, wherein:

the plurality of magnets in the second component are configured to produce a weak magnetic flux directed away from the non-magnetic separation and a strong magnetic flux directed towards the non-magnetic separation.

4. The magnetic coupling mechanism of claim 1, wherein:

the first component is configured to axially translate; and wherein the second component is biased to axially translate by the plurality of strong magnetic flux.

5. The magnetic coupling mechanism of claim 1, wherein:

the first component is configured to rotationally translate; and wherein the second component is biased to rotationally translate by the plurality of strong magnetic flux.

6. The magnetic coupling mechanism of claim 1, wherein:

the first component and the second component are separated by the non-magnetic separation.

7. The magnetic coupling mechanism of claim 1, wherein the first component and the second component are located within the energy harvesting device.

8. The magnetic coupling mechanism of claim 1, wherein:

the adjustable valve comprises a drive mechanism and a stem head;

wherein the drive mechanism is communicatively coupled to the unit controller;

wherein the stem head is located within the fluid chamber; and wherein the drive mechanism is configured to position the stem head in i) a first position, ii) a second position, or iii) a third position.

9. The magnetic coupling mechanism of claim 8, wherein the turbine assembly comprises a Halbach Array of magnets.

10. A method of actuating a downhole mechanism by a magnetic coupling within a downhole tool assembly, comprising:

positioning a first component in a first chamber, wherein the first component comprises a plurality of magnets, wherein the plurality of magnets are configured to produce a strong magnetic flux on a first side;

positioning a second component into a second chamber, wherein the second component comprises a plurality of magnets, wherein the plurality of magnets are configured to produce a strong magnetic flux on a second side;

wherein the first chamber and the second chamber are coupled by a non-magnetic separation;

wherein the first side of the first component is oriented towards the non-magnetic separation;

wherein the second side of the second component is oriented towards the non-magnetic separation;

magnetically coupling the strong magnetic flux on the first side of the first component to the strong magnetic flux on the second side of the second component; and actuating the second component with the first component, wherein the downhole tool assembly comprises a valve body with a flow path, an energy harvesting device, an adjustable valve, and a unit controller, wherein the flow path comprises a first fluid port within a fluid chamber fluidically coupled to a second fluid port via at least one fluid duct, wherein the energy harvesting device comprises a generator and a turbine assembly, wherein the turbine assembly is fluidically coupled to the flow path and located between the second fluid port and the fluid chamber, and wherein the turbine assembly is configured to induce rotation within the generator.

11. The method of claim 10, wherein:

the first chamber comprises the flow path for wellbore fluids.

12. The method of claim 11, further comprising:

rotating the first component with a flowrate of wellbore fluids; and generating electrical power within the second chamber in response to a rotational motion of the second component.

13. The method of claim 10, wherein:

the second chamber comprises the flow path for wellbore fluids.

14. The method of claim 11, further comprising:

positioning a first component with an actuator into i) a first position, ii) a second position, or iii) a third position; and changing a flowrate of wellbore fluids within the flow path with a second component in response to the position of the first component.

15. The method of claim 11, wherein the wellbore fluids are i) production fluids or ii) injection fluids.

16. A downhole flow control tool system, comprising:

a first component in a first chamber, wherein the first component comprises a plurality of magnets, wherein the plurality of magnets are configured to produce a strong magnetic flux on a first side;

a second component in a second chamber, wherein the second component comprises a plurality of magnets, wherein the plurality of magnets are configured to produce a strong magnetic flux on a second side, and wherein the first chamber and the second chamber are coupled by a non-magnetic separation;

a magnetic coupling by the strong magnetic flux on the first side of the first component and the strong magnetic flux on the second side of the second component; and wherein the magnetic coupling is configured to actuate the second component with the first component, a valve body with a flow path;

an energy harvesting device;

an adjustable valve; and a unit controller, wherein the flow path comprises a first fluid port within a fluid chamber fluidically coupled to a second fluid port via at least one fluid duct, wherein the energy harvesting device comprises a generator and a turbine assembly, wherein the turbine assembly is fluidically coupled to the flow path and located between the second fluid port and the fluid chamber, and wherein the turbine assembly is configured to induce rotation within the generator.

17. The downhole flow control tool system of claim 16, wherein actuating the second component with the first component further comprises:

rotating the first component within the flow path with a flowrate of wellbore fluids; and generating electrical power within the second chamber in response to a rotational motion of the second component.

18. The downhole flow control tool system of claim 16, wherein actuating the second component with the first component further comprises:

positioning the first component with an actuator into i) a first position, ii) a second position, or iii) a third position; and changing a flowrate of wellbore fluids within the flow path with the second component in response to the position of the first component.

* * * * *